US006568237B1

(12) United States Patent
Graham et al.

(10) Patent No.: US 6,568,237 B1
(45) Date of Patent: May 27, 2003

(54) APPARATUS AND METHOD FOR VEHICLE MANIPULATIVE ANCHORING

(75) Inventors: James C. Graham, Waukesha, WI (US); James G. Ballard, Waukesha, WI (US)

(73) Assignee: Hein-Werner Corporation, Waukesha, WI (US)

( * ) Notice: Subject to any disclaimer, the term of this patent is extended or adjusted under 35 U.S.C. 154(b) by 0 days.

(21) Appl. No.: 09/924,166

(22) Filed: Aug. 7, 2001

Related U.S. Application Data

(60) Provisional application No. 60/223,796, filed on Aug. 8, 2000.

(51) Int. Cl.[7] ..... B21J 13/08

(52) U.S. Cl. ..... 72/457; 72/296; 72/705

(58) Field of Search ..... 72/295, 296, 300, 72/311, 316, 379.2, 457, 705

(56) References Cited

U.S. PATENT DOCUMENTS

| | | | | | |
|---|---|---|---|---|---|
| 4,519,236 | A | | 5/1985 | Celette | 72/457 |
| 4,915,342 | A | * | 4/1990 | Nilsson | 248/500 |
| 4,941,765 | A | | 7/1990 | Horan et al. | 403/107 |
| 4,986,107 | A | * | 1/1991 | Peyret | 72/457 |
| 5,054,307 | A | | 10/1991 | Wisner | 72/457 |
| 5,131,257 | A | | 7/1992 | Mingardi | 72/457 |
| 5,413,303 | A | | 5/1995 | Lee | 248/354.1 |
| 5,417,094 | A | | 5/1995 | Chisum | 72/34 |
| 5,613,397 | A | | 3/1997 | Johansson | 72/422 |
| 5,634,368 | A | * | 6/1997 | Venalainen | 72/457 |
| 6,185,982 | B1 | | 2/2001 | Ballard et al. | 72/457 |
| 6,216,524 | B1 | * | 4/2001 | Weschler | 72/457 |
| 6,308,550 | B1 | * | 10/2001 | Papesh | 72/305 |

* cited by examiner

*Primary Examiner*—Ed Tolan
(74) *Attorney, Agent, or Firm*—Foley & Lardner

(57) ABSTRACT

An apparatus and method for anchoring a vehicle with a manipulative anchoring device comprises a base configured to engage a frame removably mounted on a work surface with the base slidingly attached to the frame. An upright column is mounted in the base, with the upright column supporting an anchoring collar and a clamping platform. The anchoring collar can be rotated about the upright column and is configured to receive at least one anchoring chain. The clamping platform is configured to receive a plurality of interchangeable clamping members and can also be configured to support a force applying device, such as a fluid cylinder or a screw jack. When the vehicle manipulative anchoring device is configured with the force applying device, it is used to impart a force to the vehicle, typically to counter a force being applied to the vehicle in a different area.

11 Claims, 7 Drawing Sheets

APPARATUS AND METHOD FOR VEHICLE MANIPULATIVE ANCHORING

This application claims the benefit of U.S. Provisional Application No. 60/223,796 filed Aug. 8, 2000.

BACKGROUND OF THE INVENTION

The present invention relates to vehicle repair systems, and more particularly to an apparatus and method for anchoring a vehicle to a work surface of a vehicle repair system and manipulating the vehicle with the anchoring apparatus.

With new vehicle body styles and variations in manufacturing techniques being introduced in the manufacture of vehicles it is necessary to provide a specific set of vehicle retainers for each of the various body styles of vehicles in order to properly secure a damaged vehicle to a vehicle repair system. In order to repair a damaged vehicle, it is important for the vehicle to be securely mounted on the vehicle repair system so that the exact location of the data points on the vehicle can be measured and repaired. Various types of vehicle repair systems are utilized such as a vehicle repair rack, a repair bench, or a floor system utilized rails or anchor pots. A conventional attachment system for securing a vehicle to a vehicle repair system such as a rack, requires four double clamp type attachment devices each of which is attached to the pinch weld of a vehicle that runs along the bottom of the rocker panel of vehicle. As the body styles have changed, the pinch weld has become shorter, relocated, and in some instances eliminated, making it necessary to use a different attachment system for each type or body of a vehicle in order to hold the vehicle in the fixed position necessary during a repair operation.

Although a vertical pinch weld remains a standard point for clamping many vehicles, horizontal pinch welds and in some instances pinch welds set in an angle from the vertical are being used. In addition, some car manufacturers have introduced jack mounts such as a pin engaging a hole or a suspension pocket formed in the frame of the vehicle which requires another type of vehicle retainer. During a repair operation, each vehicle must be anchored at least two separate points and more typically at four separate points thereby requiring a vehicle repair shop to inventory at least one attachment system for each type of vehicle. This can be costly and requires considerable storage place for each attachment system. In addition, in conventional vehicle retainer systems a multitude of bolts are used for attaching the system to the vehicle repair system, typically in a plurality of holes in the work surface of the vehicle repair system and also requires a multitude of bolts to secure the vehicle retainer to the vehicle. A further complication encountered by a vehicle repair operation is that during a repair procedure it may be necessary to move the anchoring point on the vehicle or to apply a force at the anchoring point to counter a force being applied at different locations on the vehicle being repaired.

Thus, there is a need for an apparatus for securing a vehicle to a vehicle repair system that minimizes the number of bolts needed to secure the vehicle to the apparatus. There is a further need for an apparatus for securing a vehicle on a vehicle repair system that is infinitely adjustable on the work surface of the repair system and does not require a multitude of bolts for securing the apparatus to the work surface. There is also a need for an interchangeability of vehicle retainers to accommodate different ways of securing different types of vehicles to the apparatus for the repair process. There is a further need to reduce the amount of time necessary to fix the apparatus for securing a vehicle to the vehicle repair system and securing the vehicle to the apparatus itself, preferable by reducing the number of bolting operations to secure the vehicle. There is an additional need for an apparatus that can both apply a force to the vehicle and secure the vehicle being repaired.

SUMMARY OF THE INVENTION

The present invention provides an apparatus for securing a vehicle to a vehicle repair system with the vehicle repair system having a work surface. The apparatus comprises a frame removably mounted on the work surface. A support base is slidingly coupled to the frame and an upright column is coupled to the support base. The upright column has a collar stop attached proximate one end of the upright column. An anchor collar is mounted on the upright collar adjacent to and above the collar stop. The anchor collar is configured to rotate on the upright column and is also configured to receive at least one anchor chain. A clamping platform is coupled to the upright column and is configured to secure the vehicle to the vehicle repair system.

One embodiment of the invention provides a clamping platform which comprises a drive screw housing defining a draw chamber with the drive screw housing supporting a fixed jaw. A draw sleeve having a threaded screw bore is configured to slidingly engage the drive screw housing. The draw sleeve supports a movable jaw. The drive screw is coupled to the drive screw housing and configured to threadingly engage the screw bore in the draw sleeve wherein as the drive screw is rotated, the draw sleeve slides in the draw chamber. Such motion moves the two jaws toward or away from each other and is used to secure the vehicle to the vehicle repair system. Another embodiment of the invention provides coupling a force applying device to the fixed jaw of the clamping platform.

The present invention also provides an apparatus for securing a vehicle to a vehicle repair system with the vehicle repair system having a work surface. The apparatus comprises a means for mounting the apparatus on the work surface. A means for supporting coupled to the means for mounting the apparatus. An upright column is coupled to the means for supporting at one end of the column and a means for stopping is attached to the upright column at the opposite end of the column. The means for anchoring is mounted on the column above the means for stopping. The means for anchoring is configured to rotate on the column and is configured to receive an anchor chain. A means for clamping is coupled to the upright column and is used to secure the vehicle to the vehicle repair system. Another embodiment of the invention provides a means for clamping that comprises a means for housing defining a draw chamber with the means for housing supporting a fixed jaw. A means for moving having a threaded screw bore is also provided. The means for moving is configured to slidingly engage the means for housing with the means for moving supporting a movable jaw. The means for screwing is coupled to the means for housing and configured to threadingly engage the screw bore and the means for moving. When the means for screwing is rotated, the means for moving slides in the draw chamber thereby moving the jaws toward or away from each other. Another embodiment of the invention provides a means for applying a force coupled to the fixed jaw of the means for clamping.

The present invention also provides a method for securing and manipulating a vehicle on a vehicle repair system having a work surface. The method comprises the steps of placing the vehicle on the work surface. Placing a frame on the work surface and aligning the frame with a vehicle securing area on the vehicle. Mounting a support base on the frame with the support base having an upright column. Sliding the support base along the frame to align with the vehicle securing area. Installing a clamping platform on the upright column with the clamping platform having a movable jaw and a fixed jaw. Coupling a clamping member to each jaw and adjusting the clamping members to align with the vehicle at the vehicle securing area. Attaching one end of an anchor chain to an anchor collar mounted on the upright column and the other end of the anchor chain to the work surface. Then manipulating the moving jaw towards the fixed jaw, wherein the clamping members engage the vehicle and secure the vehicle to the vehicle repair system. A second, third or fourth apparatus for securing and manipulating the vehicle on the work surface can be used with each apparatus mounted on the work surface in a spaced relationship from each other.

The present invention also provides a method for securing and manipulating a vehicle on a vehicle repair system having a work surface using an apparatus for securing and manipulating the vehicle. The method comprises the steps of placing the vehicle on the work surface. Then placing a frame on the work surface and aligning the frame with the vehicle securing area of the vehicle. Mounting a support base on the frame with the support base having an upright column Sliding the support base along the frame to align with the vehicle securing area. Installing a clamping platform on the upright column, with the clamping platform having a movable jaw and a fixed jaw. Coupling a clamping member to the moving jaw. Coupling a force applying device to the fixed jaw. Attaching one end of an anchor chain to an anchor collar mounted on the upright column and the other end of the anchor chain to the work surface. Then adjusting the clamping member and the force applying device to align with the vehicle at the vehicle securing area. Manipulating the force applying device toward the vehicle wherein the clamping member and the force applying device engage the vehicle to secure the vehicle to the vehicle repair system. Then operating the force applying device to apply the force to the vehicle. A second, third or fourth apparatus for securing a vehicle to the vehicle repair system can be used with each apparatus mounted on the work surface in a spaced relationship from each other.

DETAILED DESCRIPTION OF THE PREFERRED EMBODIMENTS

Figure 1:
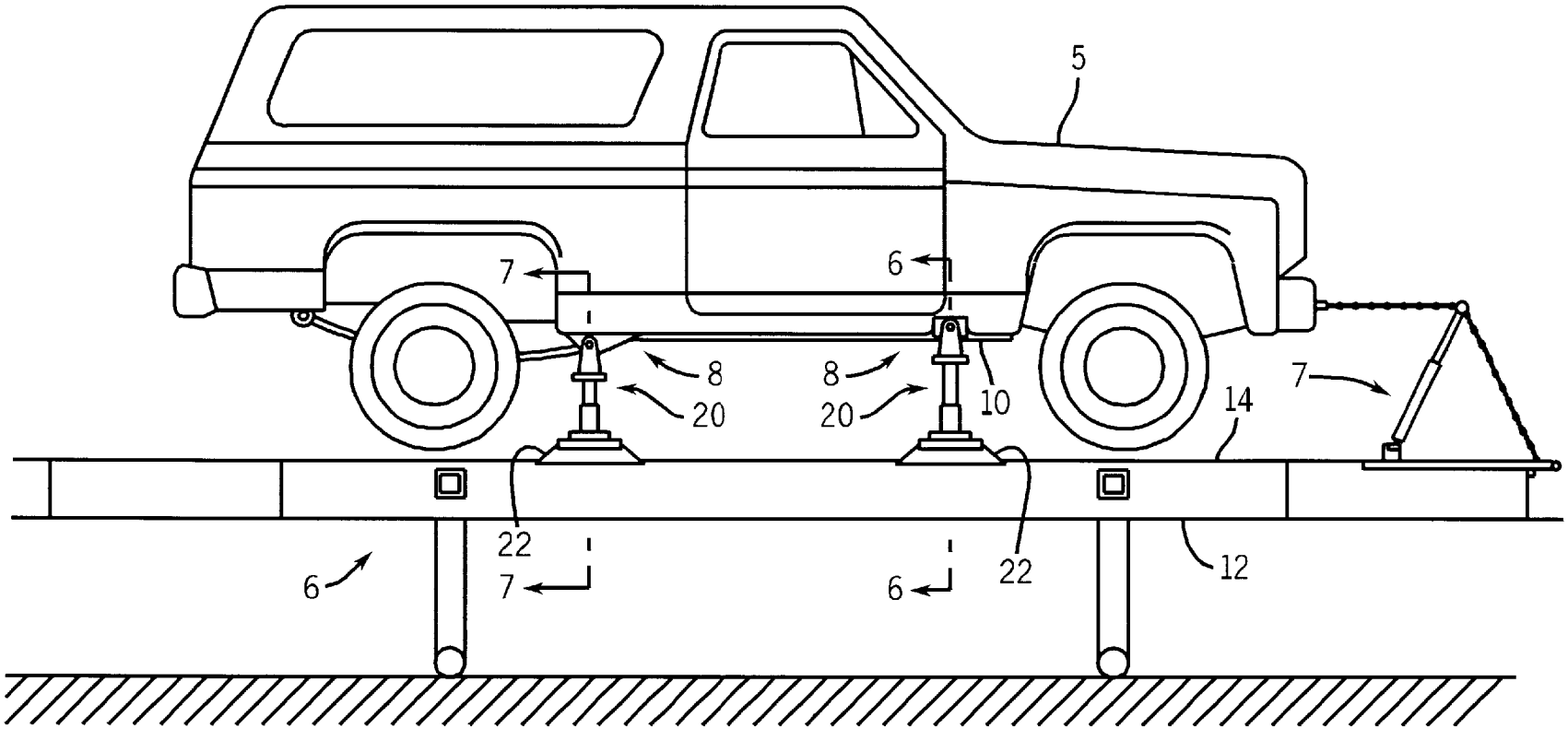
FIG. 1 is a side plan view of a vehicle secured to a vehicle repair rack type vehicle repair system with two exemplary embodiments of the apparatus for vehicle manipulative anchoring.

Referring to FIG. 1 there is illustrated a vehicle 5 mounted on a vehicle repair system 6 with two of the present apparatus for securing vehicle 20 assemblies. The illustrated vehicle repair system 6 is of the vehicle repair rack 12 type (also see FIG. 2). The vehicle repair rack 12 typically is supported above a floor or supporting surface as in an automobile repair facility. It may be supported by several pairs of stationary legs, or by leg sets that are moved from a lowered position to a raised position by hydraulic or air cylinders or the rack may be raised by a scissors, a parallelogram or other type of lift. Other types of vehicle repair systems that can utilize the present apparatus for securing vehicle 20 include a bench system or a rail system. A rail system can be mounted above the floor of the repair facility or may be mounted in the floor of the repair facility. The assignee of the present disclosure manufactures and distributes at least one type of each of the above described vehicle repair systems.

Figure 3:
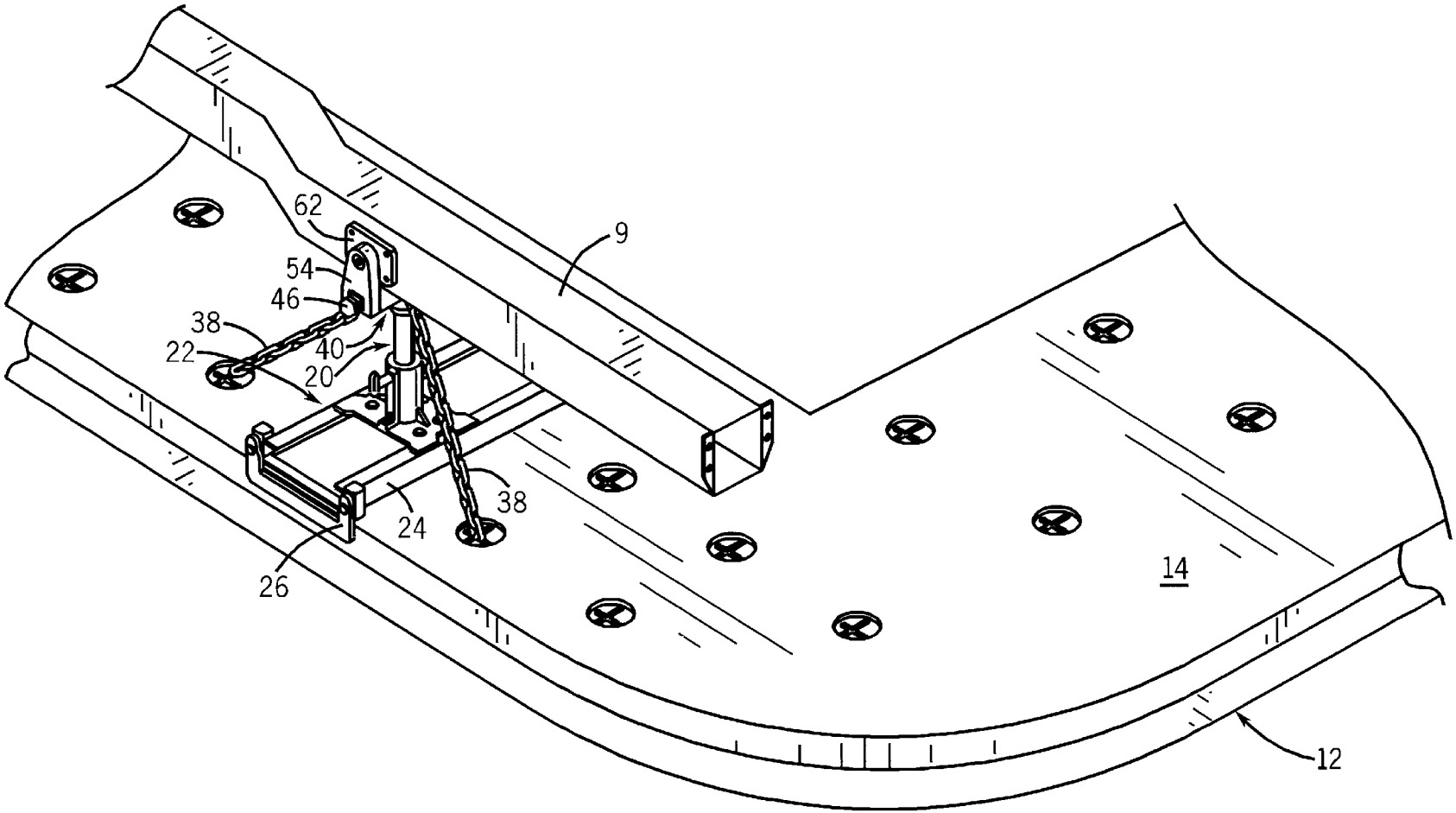
FIG. 3 is a partial perspective view of a vehicle manipulative anchoring device mounted on a frame secured to the work surface of a vehicle repair rack system, with a frame member of a vehicle secured in the clamps mounted on the clamping platform and with anchor chains secured to the anchoring collar and the repair rack.
Figure 4:
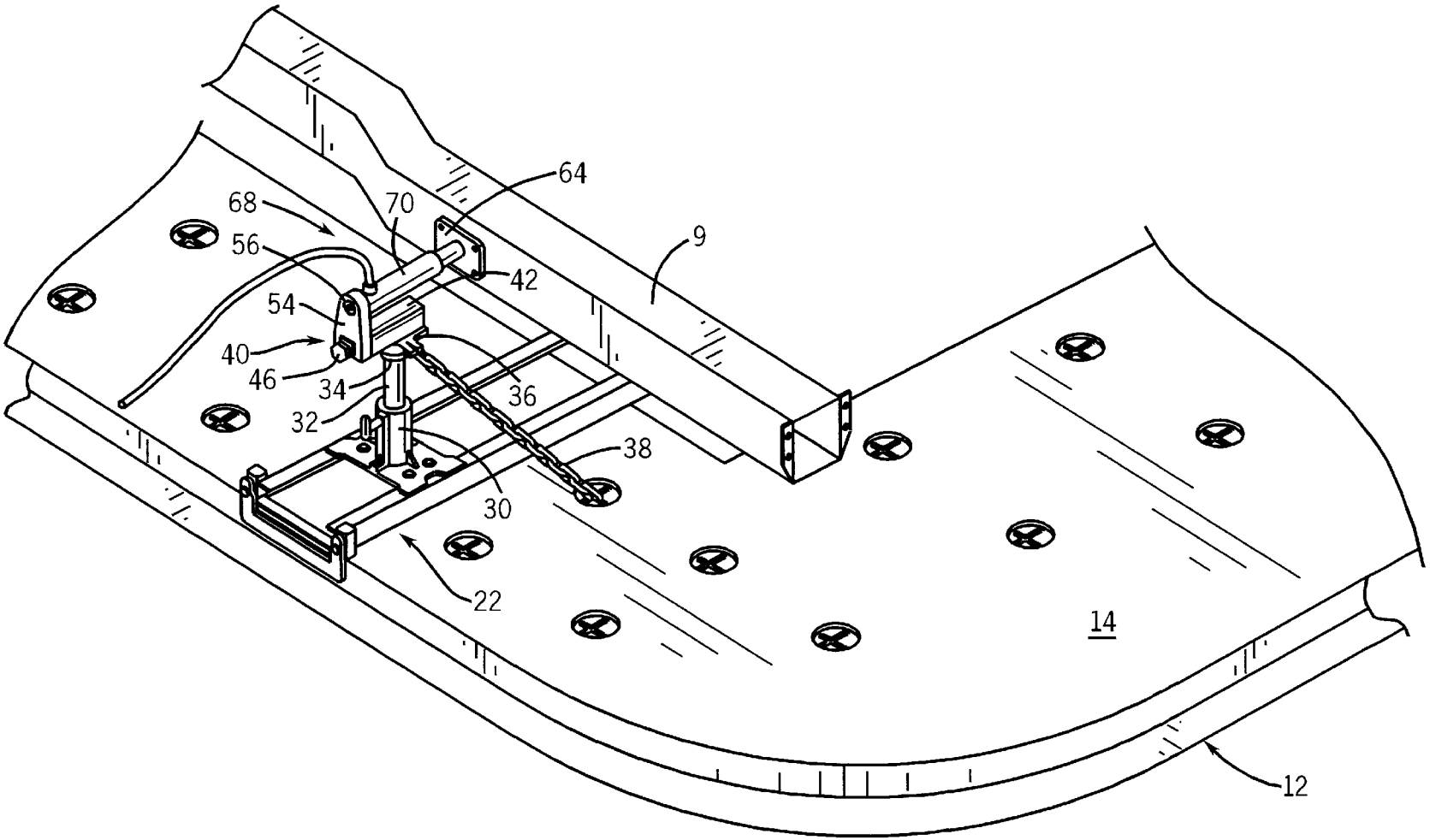
FIG. 4 is a partial perspective view of a vehicle manipulative anchoring device configured to support a hydraulic cylinder type of force applying device coupled to a vehicle frame member.
Figure 5:
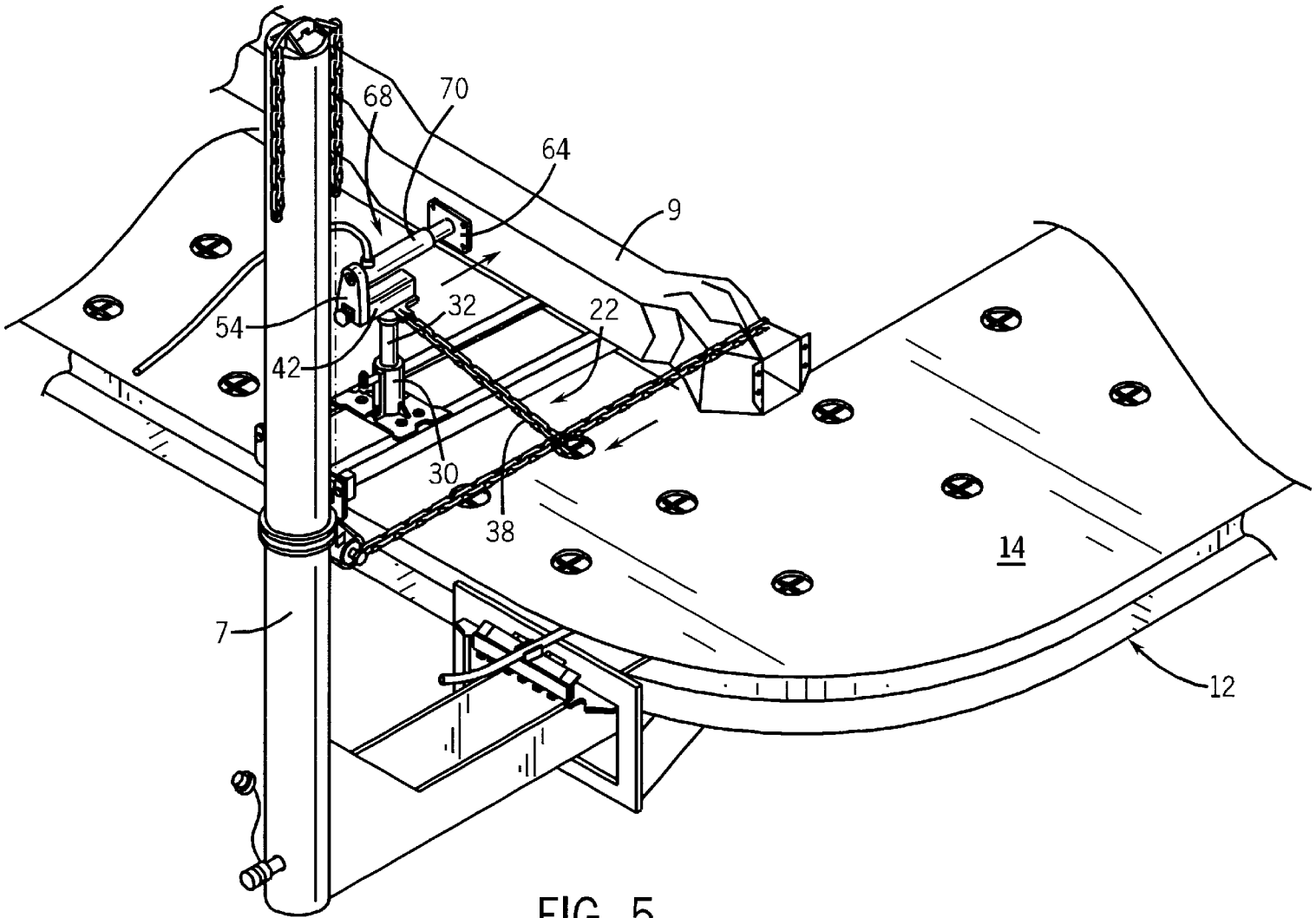
FIG. 5 is a partial perspective view of a vehicle manipulative anchoring device of FIG. 4 illustrating (arrow direction) a force applied to a vehicle frame member counter to a force applied to the same frame member by a pull tower/chain apparatus also mounted on the vehicle repair system.

The illustrated vehicle repair rack 12 includes a work surface 14 which in some cases is provided with a plurality of holes for engaging chains used in the repair procedure of the vehicle (See FIGS. 3, 4 and 5). The vehicle repair procedure typically uses a vehicle straightening assembly 7 such as the illustrated chain and hydraulic cylinder illustrated in FIG. 1. However, it should be understood that other types of vehicle straightening assemblies 7 can be utilized such as a tower mounted on the vehicle repair system 6 as illustrated in FIG. 5 or mounted on the floor of the repair facility. During a repair procedure, regardless of the type of vehicle repair system 6 or the vehicle straightening assembly 7 utilized by an operator of a vehicle repair facility, the vehicle 5 must be secured to the vehicle repair system 6 to withstand the forces applied to the vehicle by the vehicle straightening assembly 7 during the repair procedure. The present apparatus for securing a vehicle 20 facilitates the securing of the vehicle to the vehicle repair system 6 for such purposes. In the typical configuration, the apparatus for securing vehicle 20 are mounted on the vehicle repair rack 12 and secured to the work surface 14 of the vehicle repair system 6. Each vehicle 5 typically has a designated vehicle securing area 8 to which an apparatus for securing vehicle 20 engages the vehicle 5. Although a light truck is illustrated in FIG. 1, it should be understood that the present apparatus for securing vehicle 20 can be utilized with most types of vehicles including automobiles, sports utility vehicles, extended trucks, busses and other types of vehicles that are mounted on a vehicle repair system 6.

During the repair procedure, the vehicle 5 usually is suspended above the work surface 14 of the vehicle repair rack 12 during the repair procedure. The apparatus for securing vehicle 20 not only secures the vehicle to the vehicle repair system 6 but also supports the vehicle above the work surface 14 as illustrated in FIG. 1. A typical arrangement for a vehicle repair procedure utilizes four apparatus for securing vehicle 20 mounted on the work surface 14 with each apparatus for securing vehicle 20 engaging the designated vehicle securing area 8 of the specific vehicle 5 being repaired.

Referring to the Figures, there is illustrated several embodiments of an apparatus for securing a vehicle 20 to a vehicle repair system 6. The apparatus 20 comprises a frame 22 removably mounted on the work surface 14 of the vehicle repair system 6. The frame 22 is provided with two elongated substantially parallel frame members 24 which are maintained in a spaced relationship by several traverse members. One end of the frame 22 is provided with a plurality of frame retainer members 23 which engage the vehicle repair rack 12, typically the underside of the work surface 14, to assist in maintaining the frame 22 in a selected position on the work surface 14. The frame retainer member 23 can be configured to engage the work surface of the particular vehicle repair system being utilized. The other end of the frame 22 is provided with a frame clamp 26 and a frame bolt 28. The frame clamp 26 engages the work surface 14 of the vehicle repair system 6 and when the frame bolt 28 is tightened the frame 22 is fixed in position on the work surface 14 of the vehicle repair system 6. The frame clamp 26 can be configured to engage the work surface of the particular vehicle repair system being utilized. In operation, the operator of the vehicle repair system 6 moves each frame 22 to align with the vehicle securing area 8 of the vehicles 5 being repaired and when so aligned, the operator tightens the frame bolt 28 thereby fixing the position of the frame 22 of the apparatus for securing vehicle 20. Such arrangement allows for an infinitely adjustable positioning method of the frame 22 and thereby not dependent upon the several holes placed in the work surface 14 used for chains to secure the vehicle 5.

Figure 2:
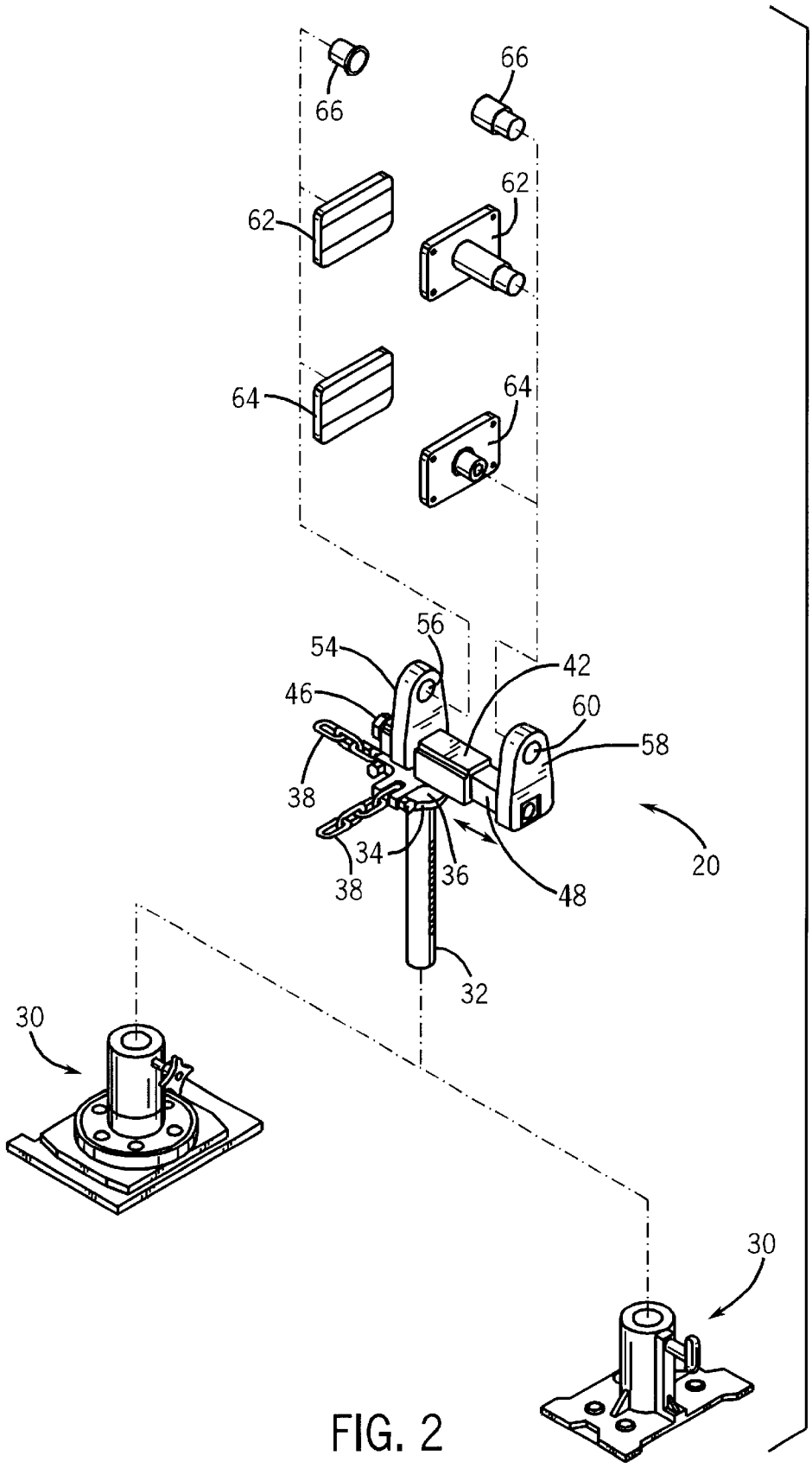
FIG. 2 is a perspective exploded view of an exemplary embodiment of an apparatus for vehicle manipulative anchoring, with two exemplary embodiments of vehicle clamps for mounting on the clamping platform of the upright column, above an anchoring collar.
Figure 6:
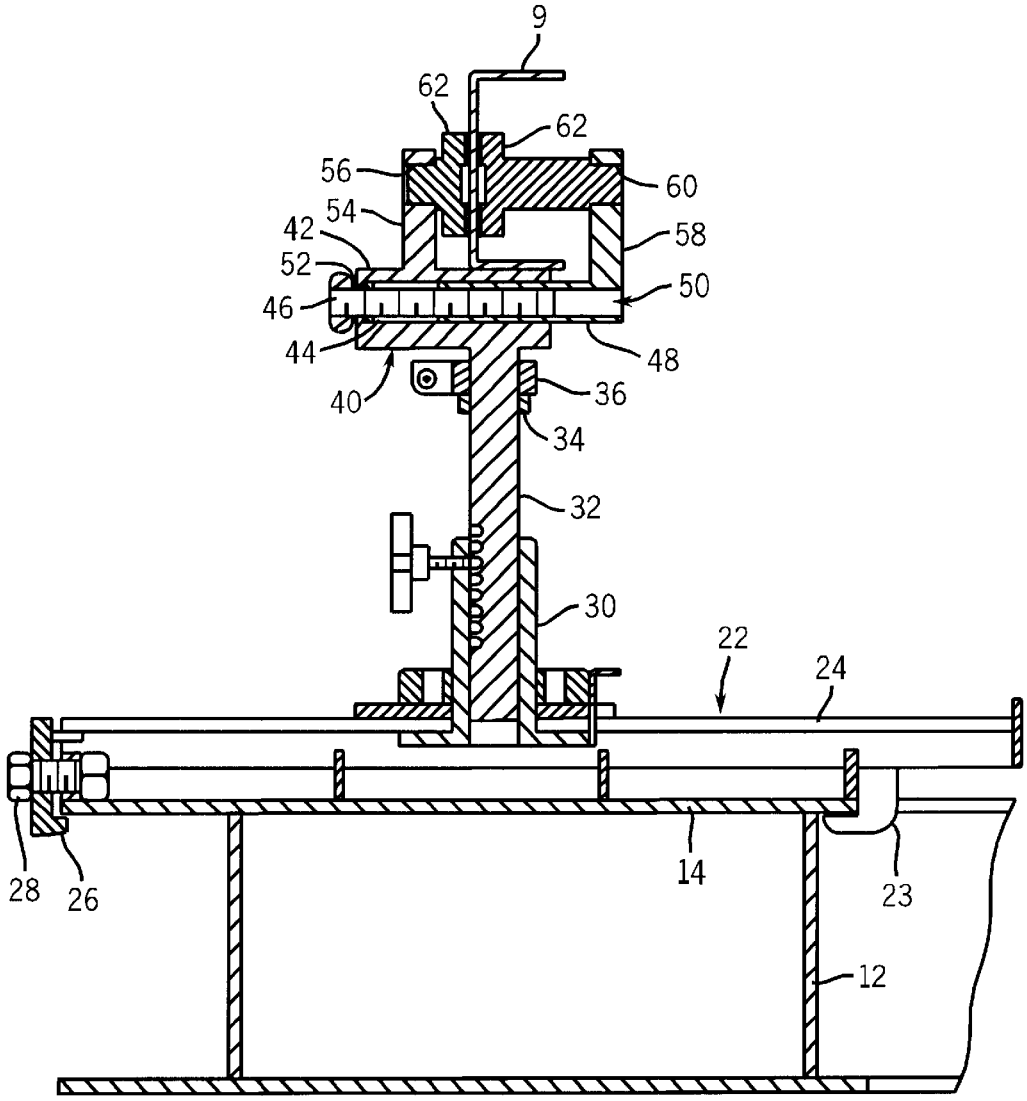
FIG. 6 is a sectional view of an exemplary embodiment of a vehicle manipulative anchoring device along the line 6—6 of FIG. 1.
Figure 7:
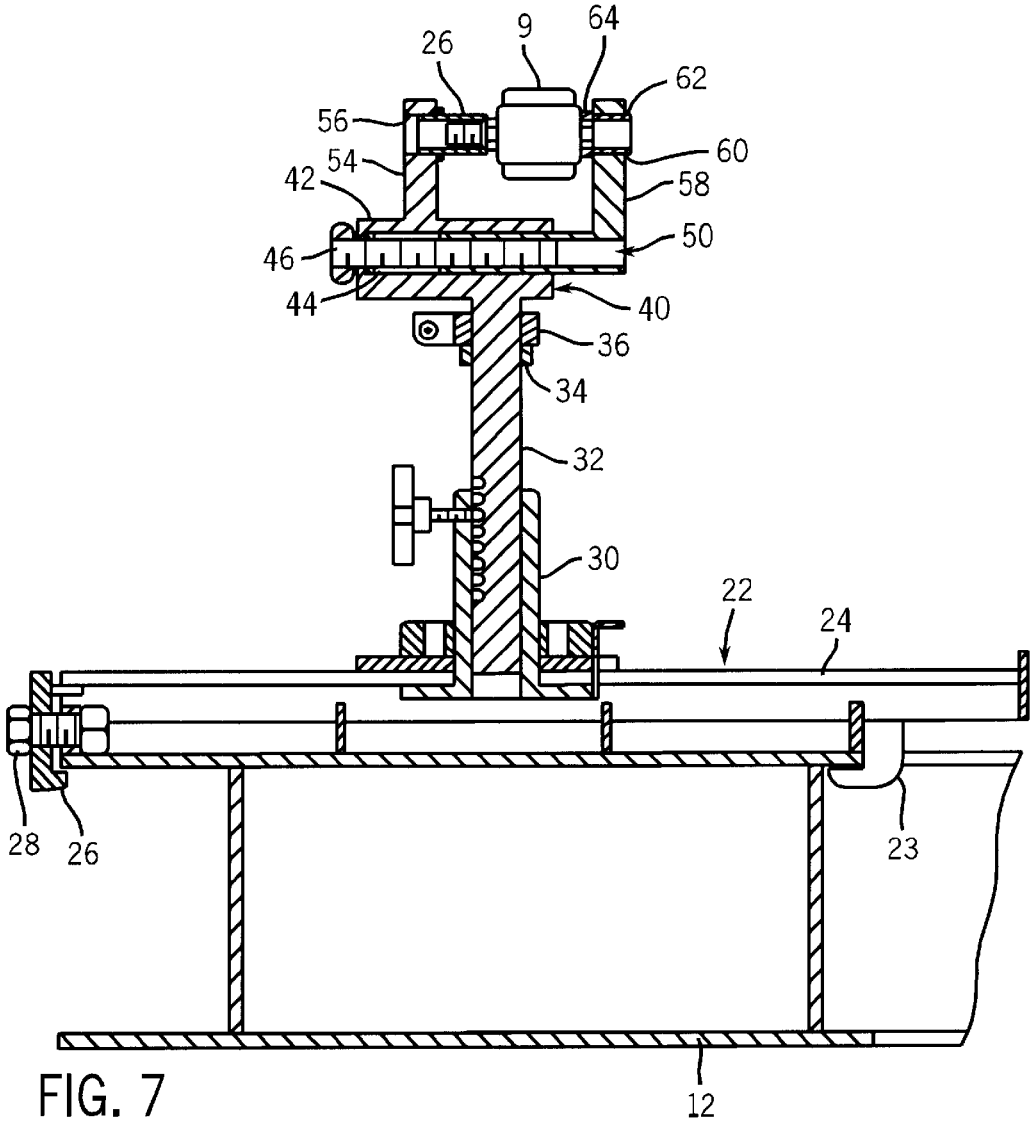
FIG. 7 is a sectional view of an exemplary embodiment of a vehicle manipulative anchoring device along the line 7—7 of FIG. 1.

A support base 30 slidingly attaches to the frame 22. FIG. 2 illustrates two different embodiments of the support base 30 that can be used with the apparatus for securing a vehicle 20. The support base 30 illustrated in FIGS. 6 and 7 provides a lock plate having a lock plate bore sized to receive the upright column 32 and is placed over the support base 30 and rests on the elongated frame member 24 of the frame 22. This arrangement sandwiches the elongated frame member 24 between the support base 30 and the lock plate. A drive nut is threadingly mounted on the upright column. The drive nut is provided with a drive nut bore having a thread portion corresponding to the thread portion of the upright column 32. An operator slides the drive nut onto the upright column and tightens the drive nut utilizing a tool. The action of tightening the drive nut while mounted on the upright column 32 secures the lock plate against the elongated frame member 24 and the frame 22 and draws the support base 30 up against the elongated frame member 24 of the frame 22 thereby securing the assembly in the position along the frame 22 as selected by the operator. It is contemplated that a suitable wrench, such as a monkey wrench or a spanner wrench can be utilized to tighten the drive nut.

The upright column 32 can be provided with location holes which when aligned with height adjustment holes in the support base 30 can be used to fix the upright column 32 in a position determined by the operator of the vehicle repair system 6. It should be understood that the height of the upright column 32 can be adjusted by using a hand knob as illustrated in FIGS. 6 and 7 or can be a spring and pin assembly or simple pin that when inserted in a location hole engages the selected height adjustment hole in the upright column 32.

A collar stop 34 is coupled to the upright column 32 as best seen in FIGS. 6 and 7. The collar stop 34 can be attached to the upright column 32 by any convenient method such as bolting, welding or threading. An anchor collar 36 is mounted on the upright column 32 above the collar stop 34. The collar stop 34 maintains the anchor collar 36 in a given height position on the upright column 32. The collar stop 34 can also be set at different height positions on the upright column 32 as determined by the operator. The anchor collar 36 is configured to freely rotate on the upright column 32 and is also configured to receive an anchor chain 38. (See FIGS. 2 and 4) One end of the anchor chain 38 is attached to the anchor collar 36 and the other end of the anchor chain 38 is coupled to the work surface 14 of the vehicle rack 12 of the vehicle repair system 6. (See FIG. 4) As shown in FIGS. 2 and 3, more than one anchor chain 38 can be attached to the anchor collar 36 and the work surface 14. The number of anchor chains 38 utilized during a particular repair procedure is determined by the operator of the vehicle repair system 6. The anchor chain 38 is attached to the anchor collar in a convenient method such as bolting as illustrated in FIG. 2 however, it is also contemplated that other methods of attachment can be utilized such as a pin and a hook. It should be understood that only appropriate chains and attachment members should be utilized to accommodate the forces to be imparted to such pieces during a vehicle repair procedure.

A clamping platform 40 is coupled to the upright column 32 above the anchor collar 36 as is seen in FIGS. 2, 6 and 7. The clamping platform 40 can be attached by any suitable means such as welding or threading.

The clamping platform 40 comprises a drive screw housing 42 which defines a draw chamber 44. The drive screw housing 42 supports a fixed jaw 54. A draw sleeve 48 having a threaded screw bore 50 is configured to slidingly engage the drive screw housing 42. The draw sleeve 48 supports a movable jaw 58. It should be understood that the designation of removable jaw is in relation to the fixed jaw 54 as will be explained below. A drive screw 46 is coupled to the drive screw housing 42 and configured to threadingly engage the screw bore 50 in the draw sleeve 48. A thrust washer 52 facilitates the engagement of the drive screw 46 with the drive screw housing 42. When an operator of the apparatus for securing a vehicle 20 rotates the drive screw 46, such rotation causes the draw sleeve 48 to slide in the draw chamber 54. The reciprocating movement imparted to the draw sleeve 48 moves the jaw 58 attached to the draw sleeve towards or away from the fixed jaw 54. It is this motion, that facilitates the securing of a vehicle frame member 9 in the clamping platform 40. The jaws 54, 58 can be attached to the housing 42 and the draw sleeve 48 by any conventional method, for example by welding, or bolting.

The fixed jaw defines a jaw bore 56 and the movable jaw 58 defines a jaw bore 60. Each jaw bore 56, 60 is configured to receive an interchangeable vehicle retainer, such as a clamp member 62, 64 or a bushing 66. The clamp members 62, 64 and the bushing 66 are configured to engage the vehicle in the vehicle securing area 8 which can be a pinch weld 10 or a vehicle frame member 9 as shown in the Figures. The clamp members 62, 64 or the bushing 66 can be interchangeably secured in the jaws 54, 58 to accommodate the type of vehicle being repaired. For example, such clamp members can be configured to engage the rear spring brackets of a truck as shown in FIG. 1 or engage the slots located in the vehicle such as those used in selected sports vehicles or engage pins such as on certain foreign made vehicles. The clamp members 62, 64 can be secured in the jaws 54, 58 by any convenient method such as bolts or quick connect sockets or other suitable means of attachment.

The fixed jaw 54 can also be coupled to a force applying device 58 as shown in FIGS. 4 and 5. The force applying device 68 can be a fluid cylinder such as a hydraulic cylinder or a pneumatic cylinder and the force applying device 68 can also be a mechanical device such as a conventional mechanical jack of the tooth and ratchet type. The force applying device 68 is coupled to the fixed jaw 54 by engagement in the jaw bore 56 and secured in place by any convenient method. A clamp member 62 or 64 can be attached to the other end of the force applying device 68 as shown in FIGS. 4 and 5.

In operation, the force applying device 68 typically pushes against the vehicle 5 as a counter force to a force imparted by a vehicle straightener assembly 7 as illustrated in FIG. 5. The vehicle frame member 9 in the Figure is coupled to the vehicle straightener assembly 7 in this case a tower assembly which pulls the vehicle frame member 9 in the direction indicated by the arrow. The counter force to that pulling force is a pushing force imparted by the hydraulic cylinder type 70 force applying device 68 pushing against the frame member 9. The amount of force imparted by the various force applying apparatus is determined by the operator of the vehicle repair system 6 in order to repair the vehicle 5 as necessary.

A typical set up during a vehicle repair procedure utilizes four apparatus for securing a vehicle 20 placed on the work surface 14 of the vehicle repair system 6. Some procedures will utilize two apparatus for securing the vehicle 20 with the second apparatus mounted on the work surface 14 in a spaced relationship from the first apparatus. The two apparatus for securing a vehicle can be mounted on the same side of the vehicle 5 as illustrated in FIG. 1 or traverse to each other. If a second, third or fourth apparatus 20 is mounted on the work surface 14 they are typically placed in a spaced relationship from each other as determined by the operator of the vehicle repair system 6.

During the repair operation, an operator may utilize a method for securing and manipulating a vehicle on a vehicle repair system 6 having a work surface 14 using an apparatus for securing and manipulating the vehicle 20. The method comprises the steps of placing the vehicle 5 on the work surface 14 placing a frame 22 on the work surface 14 and aligning the frame 22 with a vehicle securing area 8 on the vehicle 5. Then mounting a support base 30 on the frame 22 with the support base 30 having an upright column 32. Sliding the support base 30 along the frame 22 to align with the vehicle securing area 8. Installing a clamping platform 40 on the upright column 32 with the clamping platform 40 having a moving jaw 58 and a fixed jaw 54. Coupling a clamping member 62, 64 to each jaw 54, 58. Then attaching one end of an anchor chain 38 to an anchor collar 36 mounted on the upright column 32 and the other end of the anchor chain 38 to the work surface 14. Adjusting the clamping members 62, 64 to align with the vehicle 5 at the vehicle securing area 8. Then manipulating the moving jaw 58 towards the fixed jaw 54 wherein the clamping members 62, 64 engage the vehicle 5 and secure the vehicle 5 to the vehicle repair system 6. The manipulation of the moving jaw towards the fixed jaw 54 is accomplished by the rotation of a drive screw 46. The operator of the vehicle repair system 6 can use a manual wrench or a power wrench, such as an electric or pneumatic socket wrench, to rotate the drive screw 46 in either a clockwise or counter clockwise direction.

The method of securing and manipulating a vehicle on a vehicle repair system can also include the step of selecting an appropriate clamping member configured to retain the vehicle. Interchangeable clamping members can be utilized in the clamping platform 40 which depends on the type of vehicle being repaired as discussed above. The method can also include the mounting of at least an additional apparatus for securing and manipulating the vehicle 20 on the work surface 14 in a spaced relationship from the other apparatus. A third and fourth apparatus for securing and manipulating the vehicle 20 on the work surface 14 in a spaced relationship from each other and from the first and second apparatus can also be included in the method for repairing a vehicle 5 secured to the vehicle repair system 6.

Another method for securing and manipulating a vehicle on a vehicle repair system 6 having a work surface 14 in addition to the method described above includes coupling of a force applying device 68 to the fixed jaw 54 and then operating the force applying device to apply a force to the vehicle 5. The force applying device can be selected from a group consisting of a hydraulic cylinder 70, pneumatic cylinder and a mechanical jack. As in the first described method, additional apparatus for securing and manipulating the vehicle 20 on the work surface 14 can be utilized in combinations of 2, 3 or 4 such apparatus.

Thus, it should be apparent that there has been provided an apparatus and method for securing and manipulating a vehicle on a vehicle repair system. While several embodiments of the present invention have been disclosed and described in detail herein, various modifications can be made. For example, the apparatus for securing and manipulating a vehicle can be mounted on an in-floor track system or it can be mounted on a floor and secured by an anchor pot apparatus. By the way of further modification, a hydraulic cylinder or a pneumatic cylinder could be coupled to the upright column 32 to adjust the height of the clamping platform 40 to accommodate a particular vehicle being repaired on a selected vehicle repair system 6. It is also contemplated that the apparatus for securing and manipulating a vehicle 20 can be utilized on an aircraft or a water craft. Such modifications and variations in use are intended to fall within the scope of the appended claims.

What is claimed is:

1. An apparatus for securing a vehicle to a vehicle repair system with the vehicle repair system having a work surface, the apparatus comprising:

a frame removabley mounted on the work surface;

a support base slidingly coupled to the frame;

an upright column coupled to the support base with a collar stop attached to the upright column;

an anchor collar mounted on the upright column, with the anchor collar configured to rotate on the upright column and configured to receive an anchor chain; and, a clamping platform coupled to the upright column, wherein the clamping platform comprises:

a drive screw housing defining a draw chamber, with the drive screw housing supporting a fixed jaw;

a draw sleeve having a threaded screw bore, the draw sleeve configured to slidingly engage the drive screw housing with the draw sleeve supporting a movable jaw; and, a drive screw coupled to the drive screw housing and configured to threadingly engage the screw bore in the draw sleeve, wherein as the drive screw is rotated the draw sleeve slides in the draw chamber, and wherein the fixed jaw is coupled to a force applying device.

2. The apparatus of claim 1, wherein the fixed jaw and the movable jaw each define a jaw bore, with the jaw bore configured to receive a clamp member.

3. The apparatus of claim 1, wherein the force applying device is selected from a group consisting of a hydraulic cylinder, a pneumatic cylinder, and a mechanical jack.

4. An apparatus for securing a vehicle to a vehicle repair system with the vehicle repair system having a work surface, the apparatus comprising:

a means for mounting the apparatus on the work surface;

a means for supporting coupled to the means for mounting the apparatus;

an upright column coupled to the means for supporting with a means for stopping attached to the upright column;

an means for anchoring mounted on the column, with the means for anchoring configured to rotate on the column and configured to receive an anchor chain; and, a means for clamping coupled to the upright column, wherein the means for clamping comprises:

a means for housing defining a draw chamber, with the means for housing supporting a fixed jaw;

a means for moving having a threaded screw bore, the means for moving configured to slidingly engage the means for housing with the means for moving supporting a movable jaw; and, a means for screwing coupled to the means for housing and configured to threadingly engage the screw bore in the means for moving, wherein as the means for screwing is rotated the means for moving slides in the draw chamber, and wherein the fixed jaw is coupled to a means for applying a force.

5. The apparatus of claim 4, wherein the fixed jaw and the movable jaw each define a jaw bore, with the jaw bore configured to receive a means for holding.

6. The apparatus of claim 4, wherein the a means for applying a force is selected from a group consisting of a hydraulic cylinder, a pneumatic cylinder, and a mechanical jack.

7. A method for securing and manipulating a vehicle on a vehicle repair system having a work surface using an apparatus for securing and manipulating the vehicle, the method comprising the steps of:

placing the vehicle on the work surface;

placing a frame on the work surface and aligning the frame with a vehicle securing area on the vehicle;

mounting a support base on the frame with the support base having an upright column;

sliding the support base along the frame to align with the vehicle securing area;

installing a clamping platform on the upright column, with the clamping platform having a moving jaw and a fixed jaw;

coupling a clamping member to the moving jaw;

coupling a force applying device to the fixed jaw;

attaching one end of an anchor chain to an anchor collar mounted on the upright column and the other end of the anchor chain to the work surface;

adjusting the clamping member and force applying device to align with the vehicle at the vehicle securing area;

manipulating the force applying device toward the vehicle, wherein the clamping member and the force applying device engage the vehicle to secure the vehicle to the vehicle repair system; and, operating the force applying device to apply a force to the vehicle.

8. The method of claim 7, including the step of selecting the clamping member configured to retain the vehicle.

9. The method of claim 7, further comprising the step of mounting at least on additional apparatus for securing and manipulating the vehicle on the work surface in a spaced relationship from the other apparatus.

10. The method of claim 9, including the steps of mounting a third and fourth apparatus for securing and manipulating the vehicle on the work surface in a spaced relationship from each other and from the first and second apparatus; and, repairing the vehicle secured to the vehicle repair system.

11. The method of claim 7, wherein the force applying device is selected from a group consisting of a hydraulic cylinder, a pneumatic cylinder, and a mechanical jack.

* * * * *